US008857481B2

(12) United States Patent
Aviles et al.

(10) Patent No.: US 8,857,481 B2
(45) Date of Patent: Oct. 14, 2014

(54) REMOVABLE DRAIN FUNNEL

(75) Inventors: Josue V. Aviles, Jenkintown, PA (US); Bernard Parisi, Barnegat, NJ (US)

(73) Assignee: Franklin Machine Products, Lumberton, NJ (US)

( * ) Notice: Subject to any disclaimer, the term of this patent is extended or adjusted under 35 U.S.C. 154(b) by 925 days.

(21) Appl. No.: 13/020,078

(22) Filed: Feb. 3, 2011

(65) Prior Publication Data

US 2012/0199245 A1 Aug. 9, 2012

(51) Int. Cl.

| | |
|---|---|
| ***B65B 39/00*** | (2006.01) |
| ***E03F 5/04*** | (2006.01) |
| *D06F 39/08* | (2006.01) |
| *A47L 15/42* | (2006.01) |

(52) U.S. Cl.

CPC ..... *E03F 5/041* (2013.01); *D06F 39/083* (2013.01); *A47L 15/4223* (2013.01)

USPC ..... 141/340; 141/339; 4/679; 4/695; 210/163

(58) Field of Classification Search

CPC ..... B67C 11/00; B67C 11/02; E03F 2005/04; E03F 2005/0412–2005/0415; E03F 5/04–5/04094

USPC ..... 141/331, 339, 340; 210/163–166; 52/302.1; 137/362; 4/288, 290, 291, 4/679, 695

See application file for complete search history.

(56) References Cited

U.S. PATENT DOCUMENTS

| | | | | | |
|---|---|---|---|---|---|
| 1,766,621 | A * | 6/1930 | Fleming | 210/165 |
| 1,792,345 | A * | 2/1931 | Williams | 210/164 |
| 2,830,604 | A * | 4/1958 | Sherman, Jr. | 134/104.4 |
| 3,246,582 | A * | 4/1966 | Wade et al. | 210/165 |
| 3,973,407 | A * | 8/1976 | Vecchio | 210/136 |
| 4,203,686 | A * | 5/1980 | Bowman | 404/25 |
| 4,843,835 | A * | 7/1989 | Goetz et al. | 62/285 |
| 4,883,590 | A * | 11/1989 | Papp | 210/164 |
| 5,074,572 | A | 12/1991 | Delmerico et al. | |
| 5,472,025 | A * | 12/1995 | Conrad et al. | 141/332 |
| 5,782,035 | A * | 7/1998 | Locke et al. | 47/79 |
| 5,950,695 | A * | 9/1999 | Smith | 141/326 |
| 6,116,299 | A * | 9/2000 | Cummins et al. | 141/332 |
| 6,185,758 | B1 * | 2/2001 | Croon et al. | 4/613 |
| 6,260,590 | B1 * | 7/2001 | Ziegmann | 141/332 |
| 6,269,495 | B1 * | 8/2001 | Sondrup | 4/679 |
| 6,425,424 | B1 * | 7/2002 | Ellis Calvo et al. | 141/331 |
| 6,687,925 | B2 * | 2/2004 | Minnick | 4/613 |
| 6,766,545 | B2 * | 7/2004 | Hodges | 4/679 |
| 7,284,581 | B2 * | 10/2007 | Steinweg | 141/340 |
| 7,658,043 | B2 * | 2/2010 | Wroblewski | 52/302.1 |
| 7,735,512 | B1 * | 6/2010 | Ismert et al. | 137/362 |
| 7,886,782 | B1 * | 2/2011 | Curtis | 141/338 |

(Continued)

OTHER PUBLICATIONS

JOSAM Engineering Guide EG-1, copyright 2008 JOSAM Company, Printed in U.S.A.*

(Continued)

*Primary Examiner* — Timothy L Maust

(74) *Attorney, Agent, or Firm* — Howson & Howson LLP

(57) ABSTRACT

The application provides a funnel, funnel assembly, and a system for eliminating splash from drain pipes that discharge from an elevation above a floor drain.

18 Claims, 6 Drawing Sheets

(56) References Cited

U.S. PATENT DOCUMENTS

| | | | | |
|---|---|---|---|---|
| 8,006,449 | B2 * | 8/2011 | Warnecke | 52/302.6 |
| 8,012,346 | B2 * | 9/2011 | Peters et al. | 210/170.03 |
| 8,261,379 | B2 * | 9/2012 | Miller | 4/679 |
| 8,347,906 | B1 * | 1/2013 | Ismert et al. | 137/15.01 |
| 8,505,125 | B1 * | 8/2013 | Chia et al. | 4/289 |
| 2006/0267336 | A1 * | 11/2006 | Peters et al. | 285/85 |
| 2010/0089838 | A1 * | 4/2010 | Soderstrom | 210/744 |
| 2010/0176041 | A1 * | 7/2010 | Schlueter | 210/163 |
| 2012/0266372 | A1 * | 10/2012 | Epstein et al. | 4/290 |

OTHER PUBLICATIONS

Foster Jr. Frable, Water, water everywhere and not a drain in sight: a primer on kitchen drainage, http://findarticles.com/p/articles/mi_m3190/is_11_36/ai_84019667/ , Business Publications, Mar. 18, 2002, Gale, Cengage Learning.

Jay R. Smith Mfg. Co., Funnel-Ceptor Indirect Waste Drains, Drawing No. S3650, File created Sep. 6, 1996, modified Oct. 9, 2006 (downloaded .pdf document properties attached).

* cited by examiner

FIG. 6
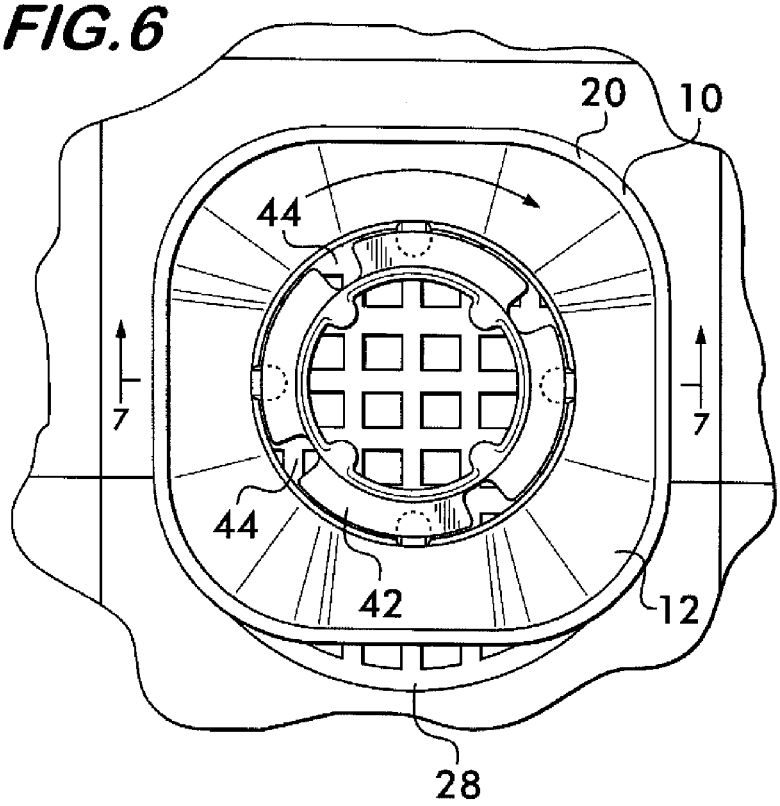
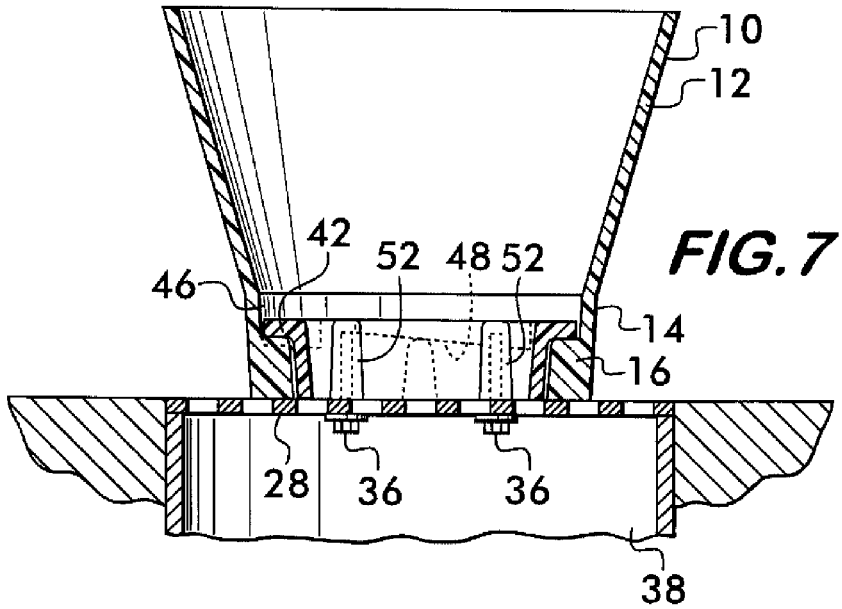
FIG. 7

REMOVABLE DRAIN FUNNEL

BACKGROUND OF THE INVENTION

Commercial sinks, dishwashers, ice machines, and like apparatus in restaurants, commercial kitchens, and like facilities often have drain pipes that are not physically connected to drainage lines and systems of the facility. For instance, some drain pipes of apparatus may be required to terminate a spaced distance above a floor drain thereby providing a required air gap between the drain pipe or pipes of the apparatus and the floor drain. The free flow of waste water through the gap between the end of the drain pipe or pipes of the apparatus and the floor drain can result in splash capable of creating a slippery, unsafe and potentially unsanitary floor surface.

SUMMARY OF THE INVENTION

The application provides a funnel comprising a hollow wide mouth portion at one end and a narrow cylindrical stem portion at an opposite end. The stem portion is able to be readily engaged with and locked to a separate funnel base and is able to be readily removed from engagement with the base. The attachment and removal of the funnel to the base can be accomplished quickly by hand without the use of tools.

A funnel assembly for connection to a floor drain grate is also provided. The assembly includes a drain funnel having a wide mouth portion and a cylindrical stem portion and a separate low-profile drain funnel base having an annular sidewall with a lower end securable to a floor drain grate and an upper end removably securable to the drain funnel without tools.

Additionally, a system for eliminating splash from drain pipes that discharge from an elevation above a floor drain is provided. The system includes a drain grate mounted in a mouth of the floor drain, a drain funnel having a wide mouth portion and a cylindrical stem portion, and a separate low-profile drain funnel base having an annular sidewall with a lower end secured to the drain grate with fasteners and an upper end readily and quickly securable to and removable from the drain funnel without requiring the use of tools.

BRIEF DESCRIPTION OF THE DRAWINGS

The features of the embodiments should become apparent from the following description when taken in conjunction with the accompanying drawings, in which:

FIG. 6 is a plan view of the drain funnel and base positioned in a locked condition; and FIG. 7 is a cross-sectional view of the drain funnel, base, and drain grate taken along line 7-7 of FIG. 6.

DETAILED DESCRIPTION OF THE INVENTION

Figure 1:
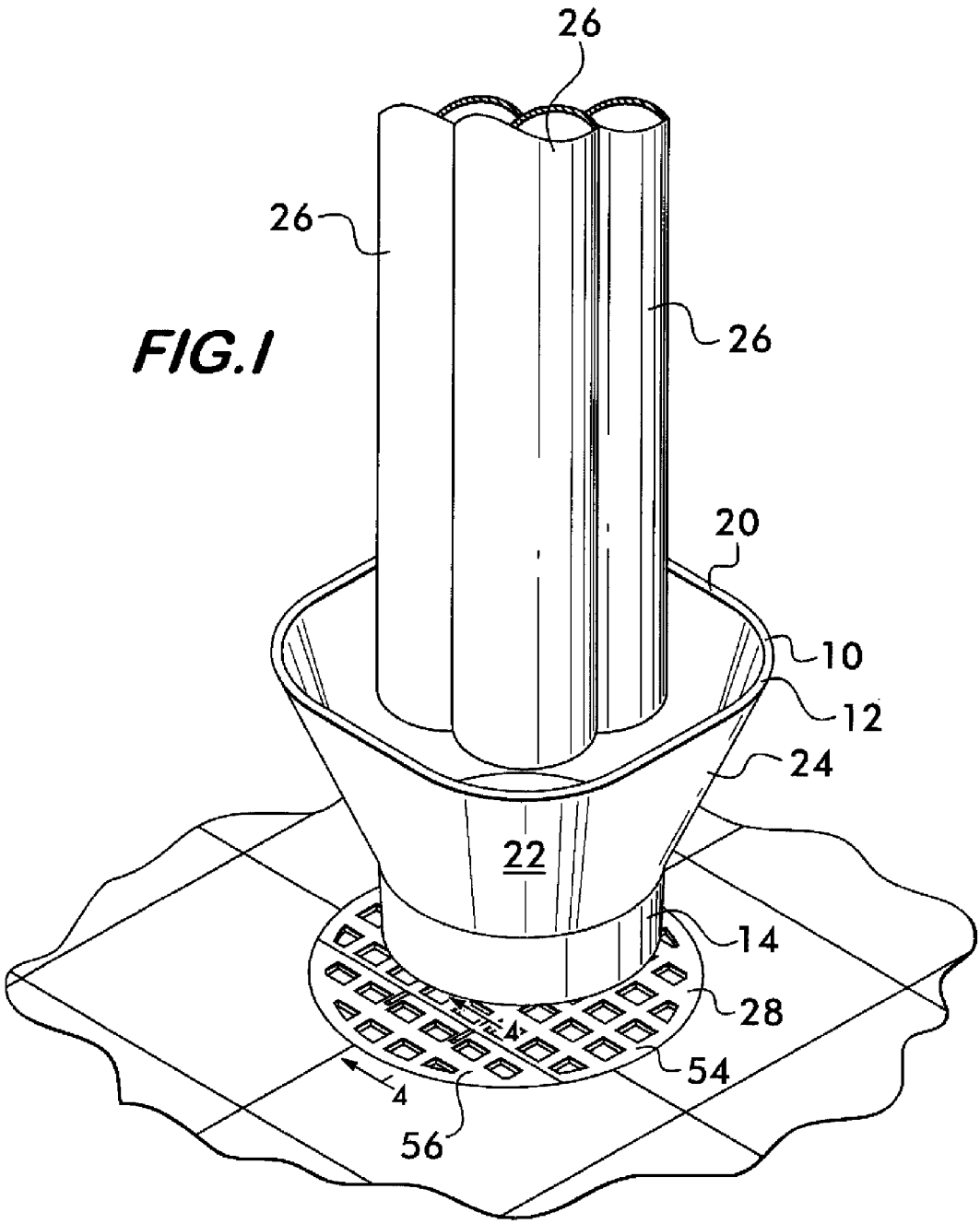
FIG. 1 is a perspective view of a drainage system including a drain funnel in a locked condition according to an embodiment of the invention.

The present application provides embodiments for eliminating drain splash such as may occur in a commercial kitchen or the like adjacent a floor drain. Further, the application provides embodiments eliminating the need to remove drain grates from their housing when a funnel is required to be connected to or disconnected from a grate, thus avoiding a hazardous condition should the grate not be promptly replaced. The embodiments also enable the use of funnels on floor grates having hinges.

According to one contemplated embodiment, a funnel 10 is provided comprising a hollow wide mouth portion 12 at one end and a narrow cylindrical stem portion 14 at an opposite end. The stem portion 14 has a series of separate inwardly-extending rib segments 16 formed on an inner diameter thereof. For example, see rib segments 16 shown in FIGS. 5 and 7. In use, the rib segments 16 permit tool-less locking engagement of the stem portion 14 of the funnel 10 to a separate funnel base 18 as explained in greater detail below. The rib segments 16 may comprise a plurality of separate circumferentially-spaced ribs that each extend in a longitudinal direction on the cylindrical stem portion 14. The illustrated embodiment shows the use of four equally-sized and equally spaced apart rib segments 16. See FIG. 5. Of course, more or less ribs 16 of the same or differing sizes can be utilized.

The funnel's mouth portion 12 has a rim 20 which according to some embodiments may be substantially square. For instance, see FIGS. 5 and 6. The funnel's mouth portion 12 can have substantially flat sidewalls 22 interconnected by rounded corners 24. In other embodiments, the mouth portion can have a substantially circular rim and a frustoconical shape. Of course, the shape of the mouth portion 12 and rim 20 can be of any shape useful for collecting waste fluids discharged from a drain pipe or pipes 26 located above and/or below the rim 20 of the funnel 10.

The funnel 10 discussed above can be connected without the use of tools to a floor drain grate 28 such that the funnel 10 is provided in an upstanding, self-supporting position on the drain grate 28. See FIGS. 1 and 7. The funnel assembly includes the drain funnel 10 having the wide mouth portion 12 and the cylindrical stem portion 14 as discussed above and, in addition, a separate low-profile drain funnel base 18 having an annular sidewall 30 with a lower end 32 securable to the floor drain grate 28 and an upper end 34 removably securable to the drain funnel 10 without tools.

Figure 2:
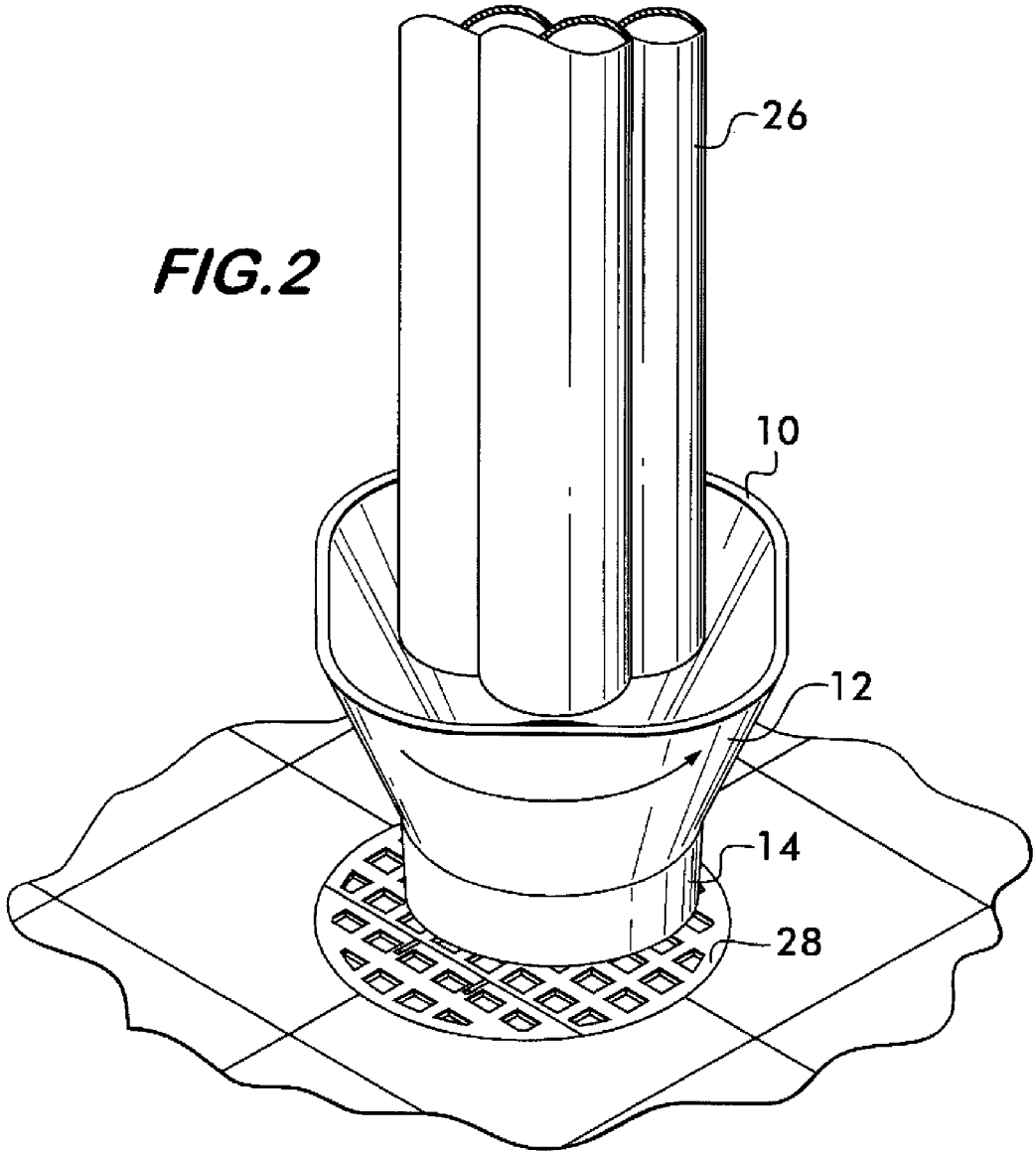
FIG. 2 is a perspective view of the drainage system of FIG. 1 showing the drain funnel rotated into position for removal.

The drain funnel base 18 can be secured with mechanical fasteners 36 (see FIG. 7) or the like directly to the floor drain grate 28, and thereafter, the drain funnel 10 can be readily and securely attached to the base 18 without the use tools. For example, see FIGS. 1-3. When desired, the drain funnel 10 can be readily removed from the assembly without the use of tools and without having to remove the base 18 from the drain grate 28 or the drain grate from the floor drain 38. When the drain funnel 10 is removed, removal or re-installation of the drain grate 28 itself can be accomplished in a more efficient manner with fewer obstacles. Also, if the drain grate 28 has a hinge 40, the absence of the drain funnel 10 permits the drain grate 28 to be pivoted about its hinge 40 without incurring obstacles. For example, see FIG. 3A. For this purpose, the drain funnel base 18 is of a sufficiently low profile such that it does not interfere with pivoting of a hinged grate or removal of a grate. Merely for purposes of example, the height of the drain funnel base 18 may be an inch or less whereas the height of the drain funnel 10 may be at least four inches if not significantly more.

Figure 3:
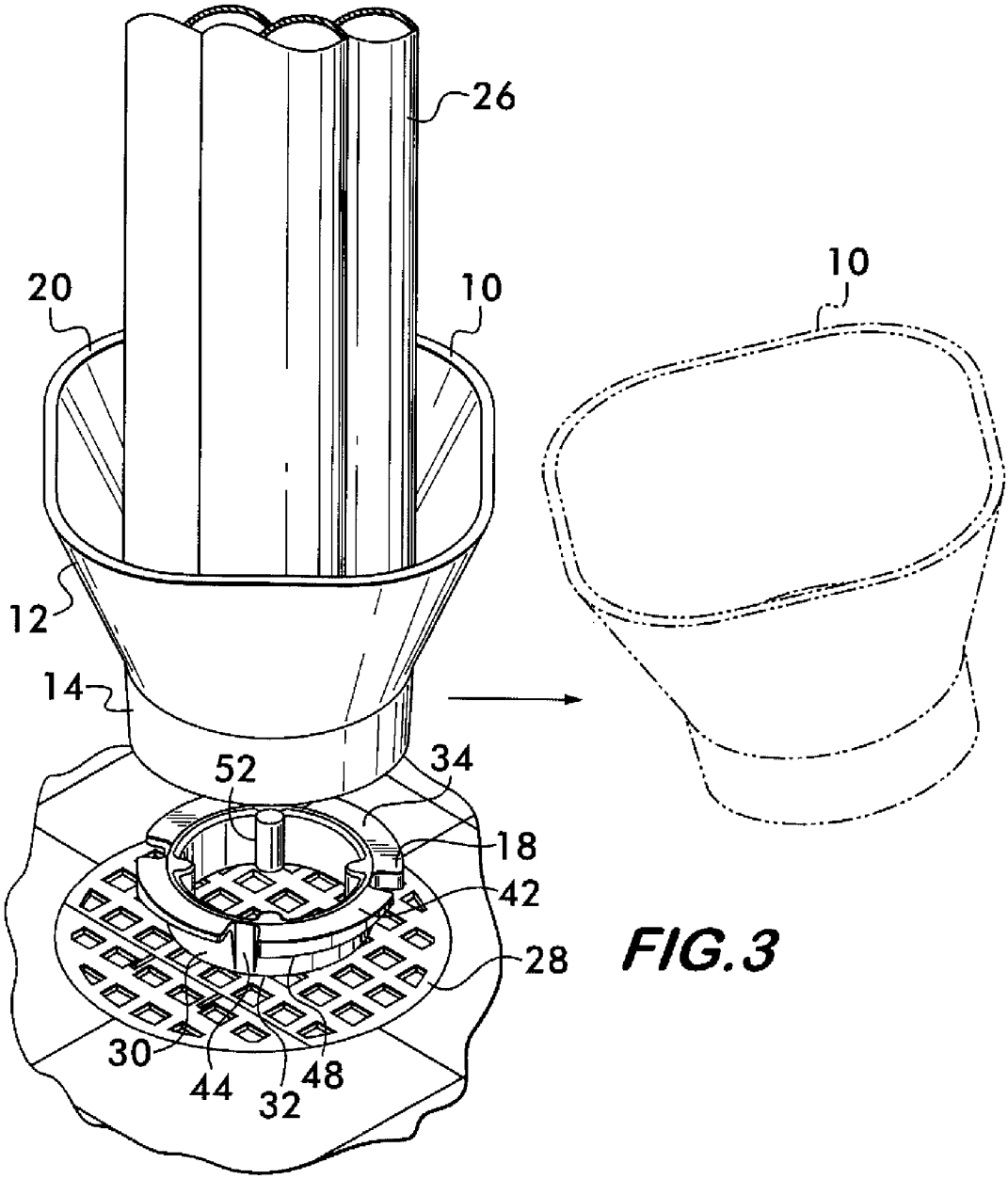
FIG. 3 is a perspective view of the drainage system of FIG. 1 showing the drain funnel removed from a separate base component of the funnel.

In the illustrated embodiment, the upper end 34 of the low-profile drain funnel base 18 has a plurality of circumferentially-spaced, radial-extending flange segments 42 extending outward from the upper end 34 of the base 18. This is best illustrated in FIGS. 3 and 7. The flange segments 42 define a plurality of gaps 44 therebetween. The layout, size and spacing of the gaps 44 correspond to that of the rib segments 16 on the stem portion 14 of the drain funnel 10. The flange segments 42, gaps 44 and rib segments 16 cooperate to permit tool-less locking engagement of the drain funnel 10 to the base 18.

Figure 5:
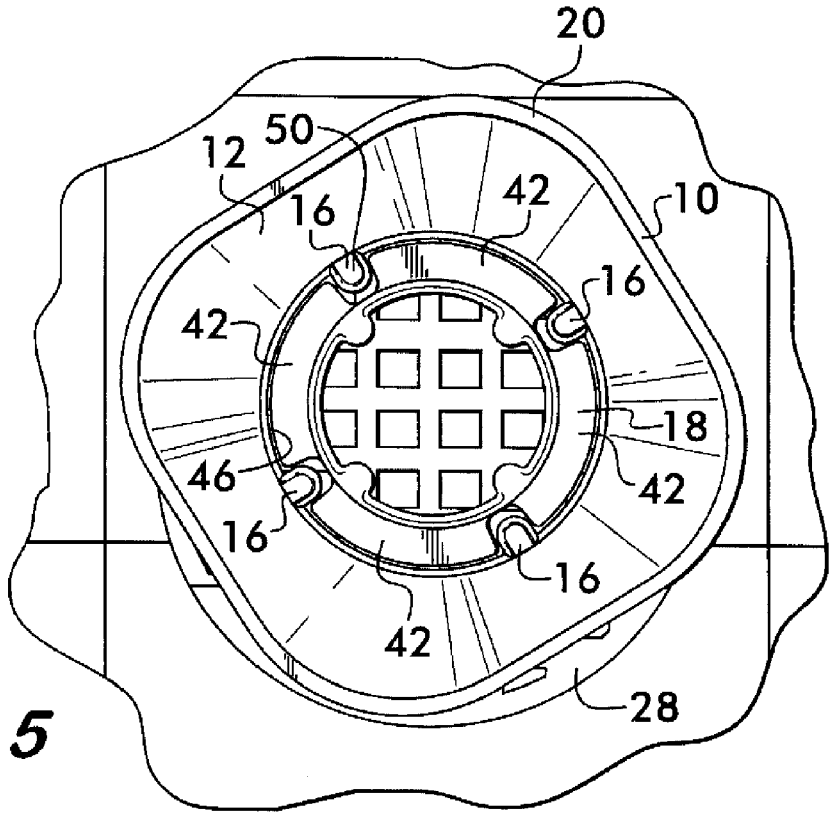
FIG. 5 is a plan view of the drain funnel and base disposed in a registered but unlocked position.

The cylindrical stem portion 14 of the drain funnel 10 has an inner diameter 46 that permits the stem portion 14 to be position over and receive the base 18 therein. This includes the flange segments 42. However, the base 18 can only be received within the stem portion 14 when the series of separate inwardly-extending rib segments 16 of the stem portion 14 are aligned and in registration with the gaps 44 provided between the flange segments 42 of the base 18. This is best illustrated in FIG. 5. When properly aligned, the rib segments 16 are permitted to extend through the gaps 44 as the drain funnel 10 is extended over the base 10. This positioning of the drain funnel 10 on the base 18 can be accomplished by hand without the use of tools. When this is accomplished, the rib segments 16 are positioned such that they can be moved beneath the flange segments 42 of the base 18. For this purpose, the drain funnel 10 can be rotated by hand relative to the stationary base 18 (for instance, as shown in FIG. 6) to locate the rib segments 16 underneath the flange segments 42 and thereby lock the drain funnel 10 to the base 18 and thereby attach the drain funnel 10 to the grate 28. This is best shown in FIGS. 6 and 7. Of course, the drain funnel 10 is removable from the base 18 when the stem portion 14 is rotated (as shown for instance in FIG. 2) to a position in which the rib segments 16 register with the gaps 44 (as shown in FIG. 5) enabling the drain funnel 10 to be lifted and separated from the base 18.

As best illustrated via the dashed lines in FIG. 7, each of the flange segments 42 of the base 18 has a lower surface 48 that tapers downward toward the lower end 32 of the base 18 as the flange segment 42 extends along a circumferential direction of the base 18. Accordingly, a height between the lower surface 48 of the flange segment 42 and the lower end 32 of the base 18 is reduced along the length of the flange segment 42. This configuration permits a stable and strong connection to be repeatedly made between the drain funnel 10 and the base 18. For example, as the drain funnel 10 is rotated into a locked position on the base 18 as shown by the arrow in FIG. 6, the upper ends 50 of the rib segments 16 are forced into tight engagement with the lower tapered surfaces 48 of the flange segments 42 to increase the frictional engagement therebetween. This arrangement prevents unwanted disconnection of the drain funnel 10 from the base 18. The rib segments 16 of the stem portion 14 can also be tapered along a longitudinal direction of the stem portion 14 as best illustrated in FIG. 7.

The base 18 of the funnel assembly includes fastening means 52 for mounting the lower end 32 of the base 18 to the underlying floor drain grate 28. The fastening means 52 in FIG. 7 is provided as an internally threaded socket for cooperating with a threaded fastener 36. Of course, any other means permitting the base 18 to be secured to the grate 28 can also be used.

The funnel 10 and funnel base 18 may be constructed of any durable material such as a plastic material, a metallic material or a composite material. In one contemplated embodiment, the funnel and base are made of the same material; however, they can also be made of different materials. It is preferred that the material be smooth and non-porous for use in food preparation areas, including kitchens and food storage rooms. The material should also be resistant to corrosion. For instance, the material can be White Tombasil, a copper based alloy resembling stainless steel having high corrosion resistance. The material can also be stainless steel and may include chromium or molybdenum. In further embodiments, the steel may be heat treated and/or surface conditioned for reduced corrosion. Still other known corrosion-resistant materials suitable for manufacturing the funnel and funnel base may be used.

The above described funnel can form part of a system for eliminating splash from drain pipes 26 that discharge waste fluids from an elevation above a floor drain 38. For example, see FIG. 1. The system can include a drain grate 28 mounted in a mouth of the floor drain 38, a drain funnel 10 having a wide mouth portion 12 and a cylindrical stem portion 14, and a separate low-profile drain funnel base 18 having an annular sidewall 30 with a lower end 32 secured to the drain grate 28 with fasteners 36 and an upper end 34 removably securable to the drain funnel 10 without tools. When the drain funnel 10 is secured to the base 18, it extends in an upstanding position on the drain grate 28 such that the mouth portion 12 of the drain funnel 10 extends near or adjacent the ends 52 of the drain pipes 26 in a position to collect waste fluids discharged from the drain pipes 26. The rim 20 of the mouth portion 12 can be located above, below or substantially at an elevation of a terminus 52 of the drain pipe or pipes 26. The structure of the drain funnel 10 and base 18 can be the same or similar to that discussed above.

Figure 3A:
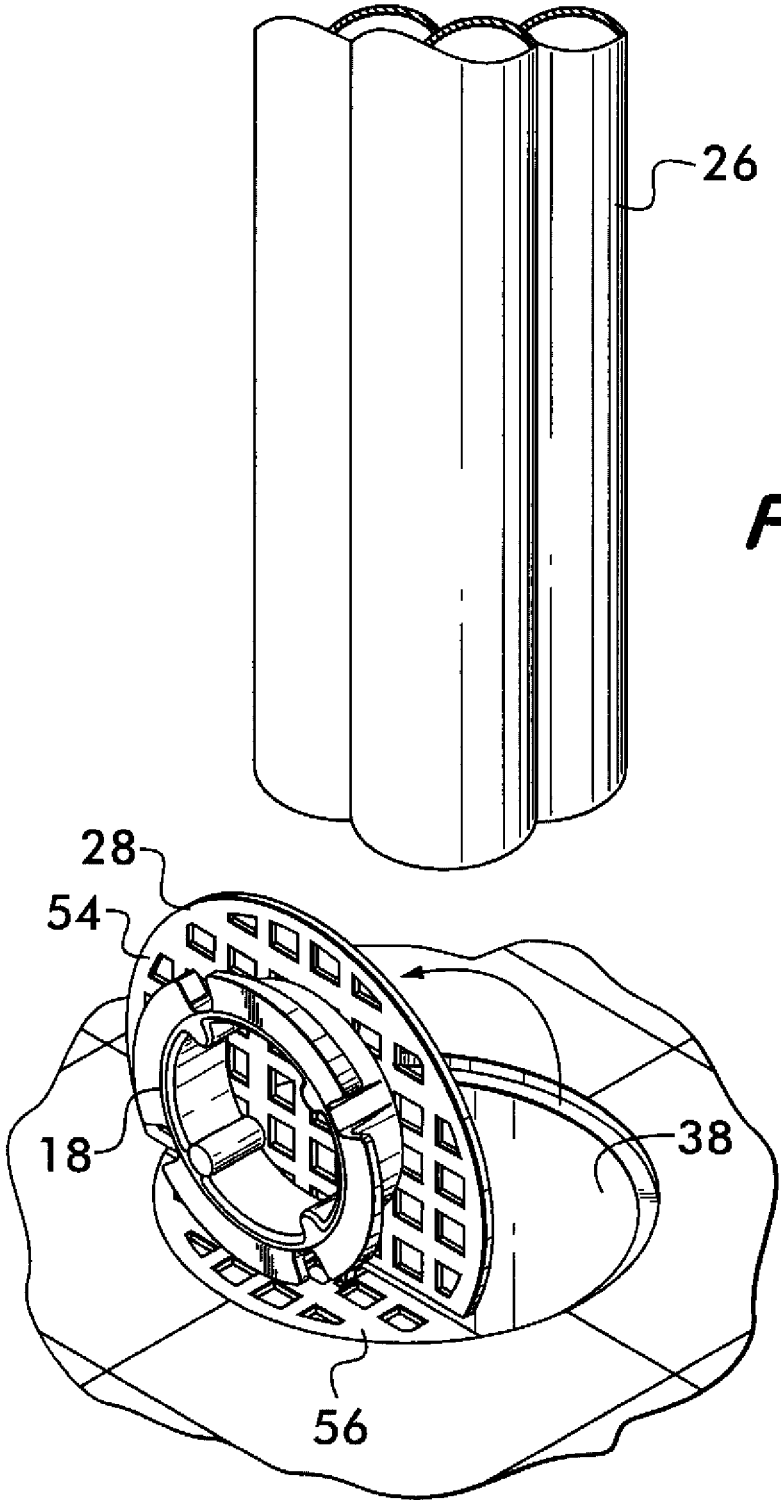
FIG. 3A is a perspective view of the drainage system of FIG. 1 showing a hinged grate of the drainage system in an open pivoted position.
Figure 4:
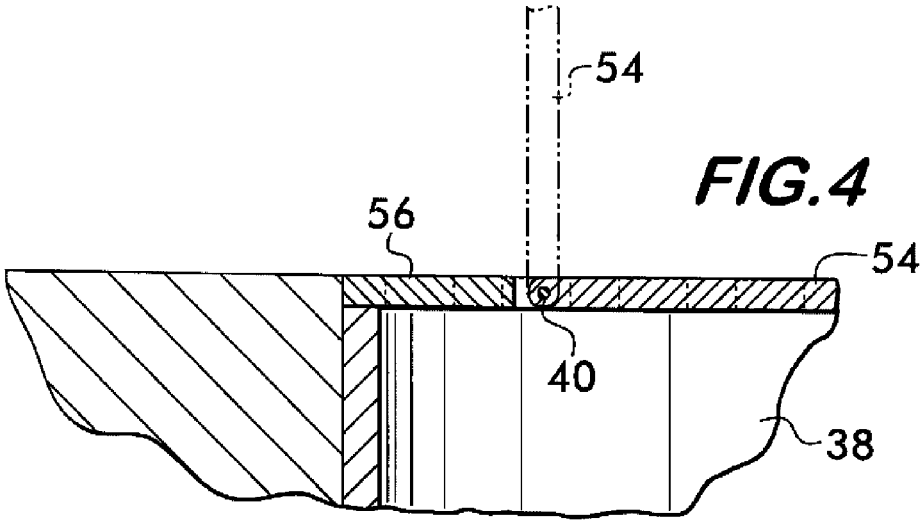
FIG. 4 is a cross-sectional view of the hinged grate taken along line 4-4 of FIG. 1.

The above described arrangement enables ready tool-less removal of the drain funnel 10 from the base 18 and therefore from the grate 28. See FIGS. 3 and 3A. Thus, after the drain funnel 10 is removed, the floor drain 38, the drain grate 28 and/or drain pipes 26 are more readily accessible for maintenance, repair, cleaning or the like. See FIG. 3A. With the drain funnel 10 attached (see FIG. 1), the grate 28 is difficult to remove from the floor drain 38 due to the drain funnel 10 impacting against the drain pipes 26. However, with the drain funnel 10 removed, the drain grate 28 is more easily removed and the drain pipes 26 provide less of an obstacle. Also, if the grate 28 has a hinge 40 (see FIG. 4), pivoting of the grate 28 is difficult due to interference between the drain funnel 10 and drain pipes 26. However, with the drain funnel 10 removed, the drain grate 28 can be readily pivoted as shown in FIG. 3A. In such an arrangement, the drain grate 28 has a hinge 40 permitting one section 54 of the drain grate 26 on which the base 18 is secured to be pivoted relative to another section 56 of the drain grate 26 which can remain stationary.

In yet an additional contemplated embodiment, the funnel can be provided with a base and a plurality of separate drain funnels having different sized mouth portions and identically sized stem portions. This enables a different sized drain funnel to be secured to the base depending on the number or size of drain pipes disposed above the floor drain.

While the invention has been described with reference to specific embodiments, it will be appreciated that modifications can be made without departing from the spirit of the invention. Such modifications are intended to fall within the scope of the appended claims.

The invention claimed is:

1. A funnel assembly for connection to a floor drain grate, comprising:

a drain funnel of a pre-determined height having an upper wide mouth portion and a lower stem portion;

a separate low-profile drain funnel base of a pre-determined height smaller than said pre-determined height of said drain funnel; and fasteners for securing said low-profile drain funnel base to an upper surface of an underlying floor drain grate such that the low-profile drain funnel base extends above the floor drain grate and floor in an upright fixed position;

said stem portion of said drain funnel being of a configuration for being removably securable to said low-profile drain funnel base without use of separate fasteners and without use of tools such that, in a locked position, said stem portion of said drain funnel is in frictional engagement with said low-profile drain funnel base for positioning said drain funnel in an upright position extending above the floor drain grate and floor and, in a disengaged position, said drain funnel is completely removed from engagement with said low-profile drain funnel base without tools.

2. The funnel assembly according to claim 1, wherein said low-profile drain funnel base has an annular sidewall with a plurality of circumferentially-spaced, radial-extending flange segments extending outward from an upper end of said base and defining a plurality of gaps therebetween, wherein said stem portion of said drain funnel is cylindrical and has an inner diameter that permits said stem portion to receive said low-profile drain funnel base including said flange segments therein, wherein said stem portion has a series of separate inwardly-extending ribs, said ribs being extendable through said gaps between said flange segments of said base and being engagable underneath and against said flange segments when said stem portion is rotated relative to said base to lock said drain funnel to said base in said locked position, and wherein said drain funnel is removable from said base and placed in said disengaged position when said stem portion is rotated to align said inwardly extending ribs of said stem portion with said gaps between said flange segments of said upper end of said base to permit separation of said drain funnel from said base without the use of tools.

3. The funnel assembly according to claim 2, wherein each of said flange segments has a lower surface that tapers toward a lower end of said base along a circumferential direction of said flange segment such that a height between said lower surface of said flange segment and said lower end of said base is reduced along said flange segment to thereby emit said ribs of said drain funnel frictional engagement with said flange segments when said stem portion of said drain funnel is rotated relative to said base.

4. The funnel assembly according to claim 3, wherein said ribs of said stem portion are tapered along a longitudinal direction of said stem portion.

5. The funnel assembly according to claim 4, wherein said base includes an internally-threaded socket for receiving said fasteners for mounting said lower end of said base to the underlying floor drain grate.

6. The funnel assembly according to claim 1, wherein the pre-determined height of said low-profile drain funnel base is one inch or less, and the pre-determined height of said drain funnel is four inches or more.

7. The funnel assembly according to claim 6, wherein said mouth portion has a rim which is substantially square.

8. The funnel assembly according to claim 7, wherein said mouth portion comprises substantially flat sidewalls interconnected by rounded corners.

9. The funnel assembly according to claim 6, wherein the mouth portion has a frustoconical shape.

10. A system for eliminating splash from drain pipes that discharge from an elevation above a floor drain, comprising:

a drain grate mounted in a mouth of the floor drain;

a drain funnel of a pre-determined height having a wide mouth portion and a cylindrical stem portion;

a separate low-profile drain funnel base of a pre-determined height smaller than said pre-determined height of said drain funnel and having an annular sidewall with a lower end secured to said drain grate with fasteners such that the low-profile drain funnel base is fixed to said drain grate and extends above the drain grate and floor;

said stem portion of said drain funnel being removably securable to said annular sidewall of said low-profile drain funnel base without use of separate fasteners and without use of tools such that, in a locked position, said cylindrical stem portion of said drain funnel is in frictional engagement with said low-profile drain funnel base for positioning said drain funnel in an upright position extending above the drain grate and floor and, in a disengaged position, said drain funnel is completely disengaged from said low profile drain funnel base without tools.

11. The system according to claim 10, wherein when said drain funnel is secured to said base, said drain funnel extends in an upstanding position on said drain grate such that said mouth portion of said drain funnel extends beyond an elevation of a terminus of a drain pipe.

12. The system according to claim 10, wherein an upper end of said low-profile drain funnel base has a plurality of circumferentially-spaced, radial-extending flange segments extending outward from said upper end of said base defining a plurality of gaps therebetween.

13. The system according to claim 12, wherein said cylindrical stem portion has an inner diameter that permits said stem portion to receive said base therein, and wherein said cylindrical stem portion has a series of separate inwardly-extending ribs, said ribs being extendable only through said gaps between said flange segments of said base and being engagable underneath and against said flange segments when said stem portion is rotated relative to said base to lock said drain funnel to said base in said locked position.

14. The system according to claim 13, wherein each of said flange segments has a lower surface that tapers toward said lower end of said base such that a height between said lower surface of said flange segment and said drain grate is reduced along a length of said flange segment enabling said ribs of said stem portion to be frictionally engaged to said flange segment when said drain funnel is rotated and secured to said base in said locked position.

15. The system according to claim 10, wherein said drain grate has a hinge permitting one section of said drain grate on which said base is secured to be pivoted relative to another section of said drain grate.

16. The system according to claim 10, wherein a plurality of drain funnels are provided with different sized mouth portions and identically sized stem portions enabling a different sized drain funnel to be secured to said base depending on the number or size of drain pipes disposed above said floor drain.

17. The system according to claim 10, further comprising at least one drain pipe terminating an elevation above the floor drain, wherein said drain funnel is aligned with said drain pipe to receive a flow of fluids discharged from said drain pipe.

18. The system according to claim 10, wherein the pre-determined height of said low-profile drain funnel base is one inch or less, and the pre-determined height of said drain funnel is four inches or more.

* * * * *

UNITED STATES PATENT AND TRADEMARK OFFICE

CERTIFICATE OF CORRECTION

PATENT NO. : 8,857,481 B2
APPLICATION NO. : 13/020078
DATED : October 14, 2014
INVENTOR(S) : Josue V. Aviles et al.

It is certified that error appears in the above-identified patent and that said Letters Patent is hereby corrected as shown below:

In the Claims

Column 5, line 51 “emit” should read “permit”

Column 5, line 52 “funnel frictional” should read “funnel to be placed in frictional”

Signed and Sealed this
Seventeenth Day of February, 2015

Michelle K. Lee

Michelle K. Lee
*Deputy Director of the United States Patent and Trademark Office*